US006412115B1

(12) United States Patent
Pontes et al.

(10) Patent No.: US 6,412,115 B1
(45) Date of Patent: Jul. 2, 2002

(54) LIGHTWEIGHT DISPOSABLE PROTECTIVE COVERALL GARMENT

(75) Inventors: Gregory D. Pontes, Gadsden; Phillip Woods, Scottsboro, both of AL (US)

(73) Assignee: Lakeland Industries Inc., Ronkonkoma, NY (US)

( * ) Notice: Subject to any disclaimer, the term of this patent is extended or adjusted under 35 U.S.C. 154(b) by 0 days.

(21) Appl. No.: 09/789,997

(22) Filed: Feb. 21, 2001

(51) Int. Cl.[7] ..... A41D 13/00
(52) U.S. Cl. ..... 2/69; 2/79
(58) Field of Search ..... 2/69, 79, 80, 69.5, 2/83, 901, 70, 902, 904, DIG. 4, 51, 243.1

(56) References Cited

U.S. PATENT DOCUMENTS 2,521,767 A * 9/1950 Zecha ..... 2/79
3,496,572 A * 2/1970 Herzig ..... 2/79
4,829,602 A * 5/1989 Harreld et al. ..... 2/51
5,487,189 A * 1/1996 Bell ..... 2/79
5,509,142 A * 4/1996 Connell et al. ..... 2/79
5,586,339 A * 12/1996 Lathan ..... 2/69 X
5,784,717 A * 7/1998 Singer ..... 2/79
5,960,475 A * 10/1999 Fewtrell ..... 2/79 X

* cited by examiner

*Primary Examiner*—Gloria M. Hale
(74) *Attorney, Agent, or Firm*—John Lezdey & Assoc

(57) ABSTRACT

A protective garment is provided from a pattern which reduces waste and provides sleeves which are attached to an upper body, portion of the garment at an angle of 45–70 degrees.

8 Claims, 3 Drawing Sheets

LIGHTWEIGHT DISPOSABLE PROTECTIVE COVERALL GARMENT

FIELD OF THE INVENTION

The invention relates to protective garments and the method of making the same. More particularly, the invention is concerned with lightweight disposable protective coverall garments.

DESCRIPTION OF THE PRIOR ART

Protective garments include woven and non-woven fabrics for disposable use. The garments are generally formed from films or fabrics of synthetic polymeric materials which are laminates and are inherently resistant to gas and liquid penetration and in some cases resistant to chemical vapor penetration. The fabrics are generally spunbonded, meltspun or related non-woven thermoplastic material.

A coverall is a protective garment to be worn over other clothing. Most coveralls are manufactured from heavy rubber or cloth such as denim and may afford protection against dirt and stains and are abrasion resistant. However, they are porous and offer no barrier to liquids, and the heavy material becomes uncomfortable, restricts movement and is cumbersome.

Not only does the heavy fabric contribute to the deficiencies of the currently available coveralls, but the design utilizes a yoke type sleeve which has stress points primarily under the arms and the seam running up the back of the coverall. In this case, overreaching may cause the seam to split.

Hazmat suits, which are made from synthetic materials, are generally light and may become torn while stretching. To overcome this problem, the suits are made extra wide. The additional width creates additional problems in maneuvering or the catching of excess fabric on objects so as to tear or get caught in emergency situations. Normally, the sleeves are attached to the garment at right angles to the armpit holes or are formed together with the upper portion at right angles to the shoulders and armpits.

Therefore, there exists a need to provide a lightweight, disposable protective coverall garment that improves fit, comfort, and freedom of movement, as well as a method of making which optimizes the use of the material of construction.

SUMMARY OF THE INVENTION

In accordance with the present invention, there is provided an improvement in a lightweight disposable protective garment, a method of making and a pattern blank which makes the manufacture more efficient. The resulting coverall is structurally stronger and more comfortable to wear, allowing the wearer more freedom of movement when bending or stretching.

The disposable protective coverall garment of the present invention comprising: an upper bodice member with an optional collar member, set sleeve members and a lower bifurcated member attached thereto, said upper bodice member being entirely in one piece, free of seams or folds and said bifurcated members formed from two leg portions to provide a relatively wide crotch and body fullness in the region of the crotch with means for closing the garment extending from the region of the crotch to the collar region when a one piece garment or along the front of the upper bodice member for a two piece garment.

In yet another embodiment, the invention provides pattern blanks that form the disposable protective coverall garment described above. The pattern blanks for forming the disposable protective one or two-piece coverall garment comprising:

an upper bodice pattern blank;

a lower torso member blank with leg forming portions;

two whole set sleeve pattern blanks or four whole sleeve pattern blanks;

and optionally, one collar pattern blank, wherein said upper bodice blank is of one piece free of seams or folds and adapted to accommodate a set sleeve configuration. The sleeves are placed on the bodice so as to form reduced stress at the armpits.

It is, therefore, a primary object of the present invention to provide an improved disposable protective coverall garment.

Another object of the present invention is to provide a disposable protective coverall garment with a garment structure that provides a more comfortable fitting garment and where the freedom of movement of the wearer is not restricted.

A further object of the present invention is to provide a disposable protective coverall garment wherein the entire back and upper front portion are made from a single piece of material.

Another object of the present invention is to provide a garment which can be easily donned and doffed.

Yet another object of the present invention is to provide pattern blanks for more efficient material utilization.

A further object of the present invention is to provide a disposable protective coverall garment with reduced stressed locations.

Yet still another object of this invention is to provide a method for making the disposable protective coverall garment of this invention.

Other objects and a fuller understanding of the invention will be had by referring to the following description and claims taken in conjunction with the accompanying drawings.

DETAILED DESCRIPTION OF THE PREFERRED EMBODIMENTS

Figure 1:
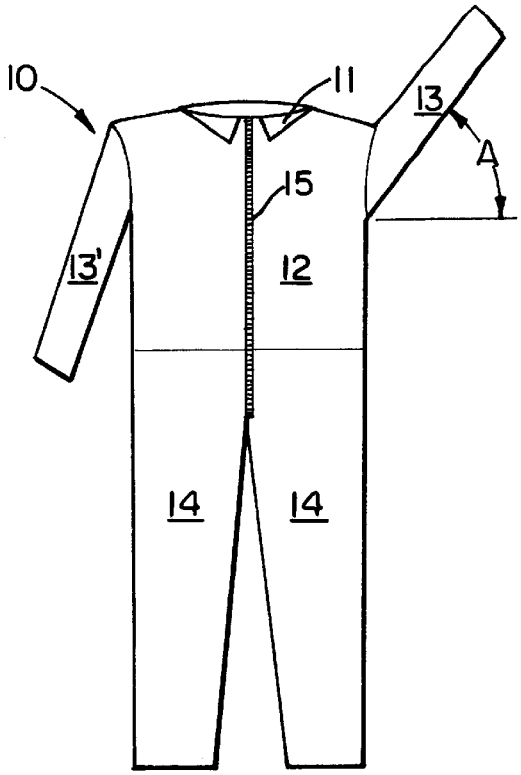
FIG. 1 is a front elevation view of the disposable protective coverall garment having set sleeves constructed in accordance with the invention.

In accordance with the present invention, FIG. 1 shows a disposable protective coverall garment 10 in which a critical stress position A is defined in an underarm location.

The disposable protective coverall garment 10, as illustrated in FIGS. 3–6, is comprised of the following pattern elements: an upper bodice member 12, a collar member 11, sleeve members 13, and lower torso members 14. The two lower torso members 14 include leg members and differ only that they are cut in a left and right mirror image relationship. Because of the similarity of the lower torso members, it is to be understood that this description is equally applicable to each. The respective lower torso members 14 extend downwardly from different locations of the upper bodice member 12, are connected at about the waistline and are positioned to cover the wearer's legs. The garment 10 is adapted to be opened generally vertically along the front and retained in a closed relation by suitable fastening means. In one preferred embodiment, the garment is provided with a frontal zipper strip 15 extending from the crotch area to an area at the top of the bodice member 12 near the neck region of the garment.

It will of course be understood that the use in the present specification and claims of various directional terms such as "generally vertically", "upper", "lower", "bottom", "front", "rear", "up", "downwardly", etc., refer to the general direction existing when the user is wearing the garment and is in a standing position. Such terms are used to facilitate description and a clear understanding of the subject matter under discussion.

It is further understood that one or two-piece garments are contemplated by the invention and that the closing means can be either on the upper portion or along the entire front when a one piece garment.

A "coverall" is a protective garment designed to be worn over other clothing. The term "disposable" is a product that is intended to be disposed rather than refurbished or cleaned.

Figure 7:
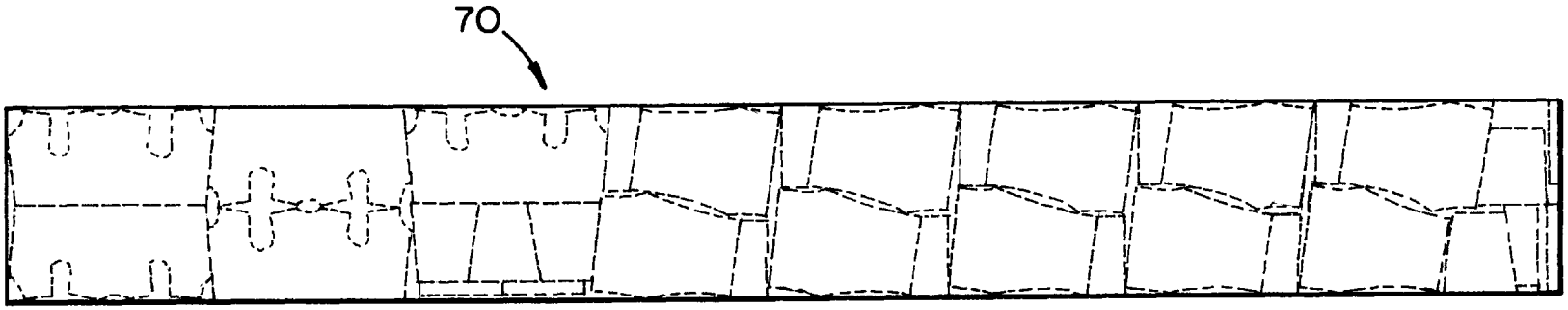
FIG. 7 is a plan view of the production layout of the pattern blanks of the present invention on the fabric or film from which the disposable protective coverall garment is formed showing the most efficient utilization of material.

As shown in FIGS. 3 through 7, the disposable protective coverall garment 10 is prepared from a fabric or film of durable polymeric material. Referring specifically to FIG. 7, there is illustrated a flat elongated rectangular sheet of film 70 which represents a segment of a roll of the polymeric material having a 60-inch width from which the garments are to be made. A first set of two identical upper bodice pattern blanks 12 are laid on film 70 in juxtaposition along the bottom edges of each blank in the manner illustrated whereby to occupy the least amount of material to avoid waste. This is followed by a second identical set of pattern blanks 12. Immediately following the two sets of pattern blanks 12, a set includes another pattern blank 12 and three collar patterns 11. Next, is a series of five sets of two lower torso patterns 14, and two sleeve patterns 13. Three collar patterns 11 complete the pattern set on the sheet.

The above-described pattern arrangement sequences need not be repeated exactly, but if generally followed provide efficient material utilization. Furthermore, the illustrated pattern arrangement of FIG. 7 can accommodate any range of sizes conforming to the specifications set in the guidelines published by the American National Standard, New York, N.Y. 10018, - Industrial Safety Equipment Association for men's limited-use and disposable protective coveralls.

Figure 8:
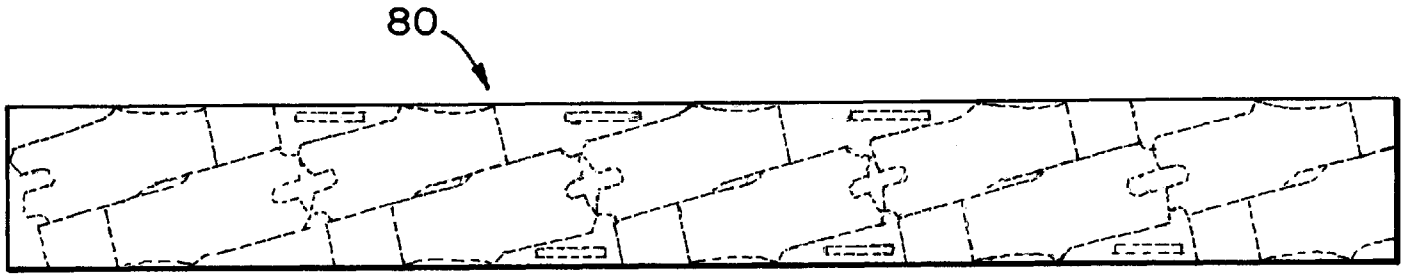
FIG. 8 is a plan view of the production layout of a typical prior art sleeve pattern blank.

In comparison, FIG. 8 shows a typical disposable protective coverall garment pattern blank 17 along with the sleeve member pattern blank 13, and collar member pattern blank 11 on the same film surface area. It is clearly shown that much more material is wasted.

Figure 3:
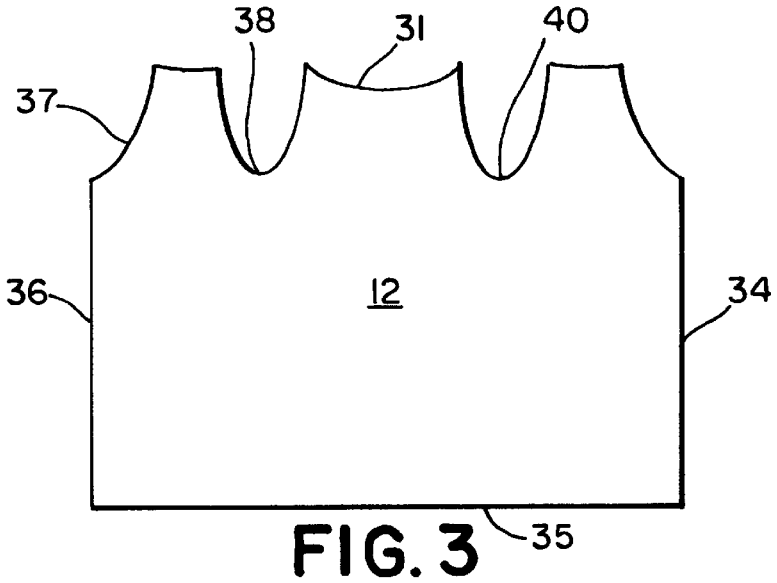
FIG. 3 is a plan view of a pattern blank from which the entire back and upper bodice portion of the garment is formed.
Figure 4:
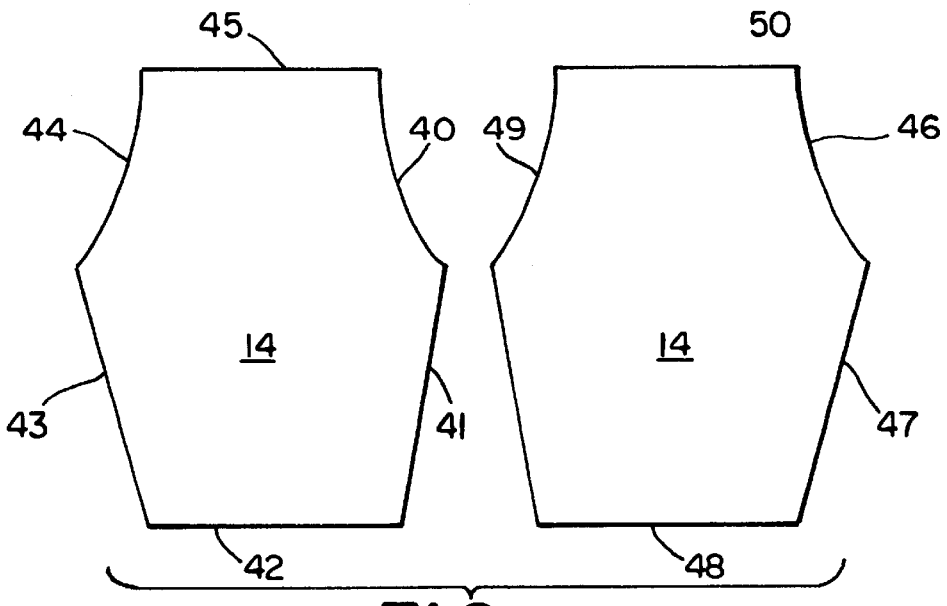
FIG. 4 is a plan view of the leg portions of the garment.
Figure 5:
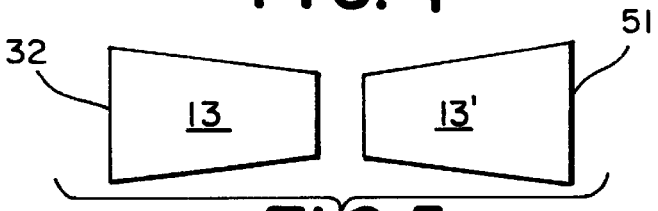
FIG. 5 is a plan view of the set sleeve portions of the garment.
Figure 6:
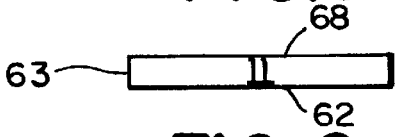
FIG. 6 is a plan view of the collar attachment of the garment.

After the patterns are laid on the film 70 in the manner illustrated in FIG. 7, the film is cut along the entire edges of the patterns 11 through 14 as illustrated in FIG. 3 to form the component parts of the garment 10. The garment 10 is assembled by the following method comprising the steps of: forming the left side of the lower torso member 14 by joining the edges of the member at the back seam, joining the front seam and joining the inseam; the right side of the lower torso member undergoes the same method of assembly except that the edges are reversed so that the leg portions are formed.

After the two leg portion members 14 are assembled, they are connected at their upper edges 45 and 50 to the upper bodice member 12 at its lower edge 35. Then the zipper strip 15 is attached to edges 34 and 36. If necessary, the remaining front seam is closed. Edge 51 of set sleeve member 13 is attached to the bodice member 12 at cutout 38 and then closed. Edge 52 of set sleeve member $\mathbf{13}^1$ is attached at cutout 32 and then closed. Next, optionally, the collar member 11 is attached at edge 31.

The members may be attached by weld sealing, fusion bonding, sonic bonding or the like, depending upon the materials utilized. Optionally, elastic bands or gathers may be added at the end of the arm portions. In the neck region of the garment, the upper bodice member may be joined to a hood (not shown). Also, hoods may have elastic or a drawstring at the face of the hood. Boots (not shown) may be attached to the leg openings if desired.

Figure 2:
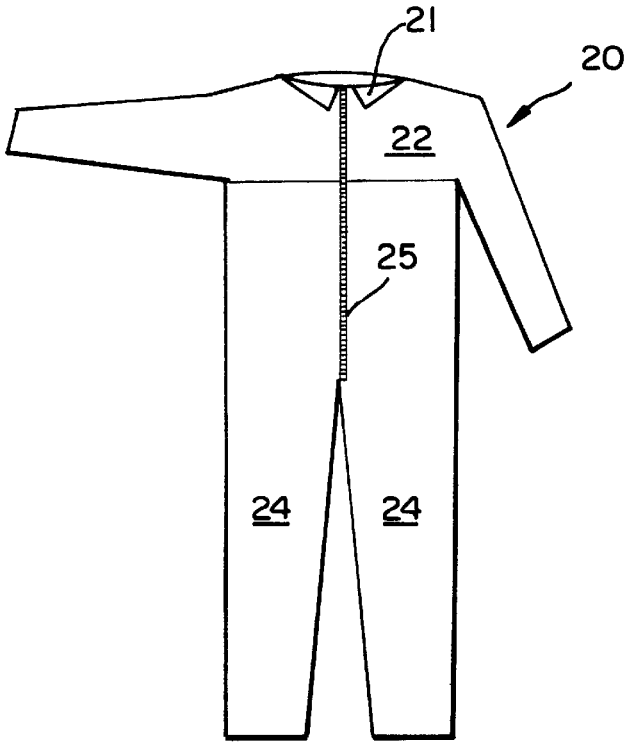
FIG. 2 is a front elevation view of a typical disposable protective coverall garment having yoke-style sleeves.

In addition to maximizing the material of construction, the disposable protective coverall garment of this invention incorporates the benefit of a set sleeve coverall and that of a separated top and bottom coverall design. FIG. 1 clearly shows more freedom of movement when the wearer stretches his arms overhead or to his front or when bending. This is opposed to a yoke type sleeve as shown in FIG. 2 where the yoke design is restrictive in its reach both to the front and overhead and while bending. This is quite apparent when comparing critical stress position A of the garment made according to this invention and critical stress position B as shown in FIG. 2.

A key feature in forming the protective garment is that the sleeves are placed on the body of the garment so as to reduce stress which normally occurs at the armpits when the arms are raised. This is achieved by the use of elongated tubular sleeves 12, 12' members having a greater diameter at the point of attachment to the upper bodice member than at the wrist portion. Also, the tubular sleeves, 13, 13' are attached at the cut-onto 40, 38 at the edge at an angle of about 45 to 70 degrees to the horizontal.

The fabric material used in the invention may comprise a polymeric material which is a single layer or multi-layered construction, as desired. They are generally thermoplastic non-woven fabrics such as spunbonded polyester, meltspun polyester, hydroentangled polyester, and the like. Illustrative of the polymer material are polyolefins such as polyethylene, polypropylene, other polymers derived from ethylenically unsaturated monomers including vinyl alcohol, vinyl chloride, vinylidene chloride, and the like. In addition, polyesters, nylon or mixed fibrous webs may be used. Most preferred are web panels comprising TYVEK®, a spunbonded non-woven polyethylene web (I.E. DuPont de Nemours & Company, Inc. Wilmington, Del.).

Alternatively, the web panels or garments of the present invention may be of laminated form, comprising a plurality of associated layers of materials such as those previously described in respect of mono-layer panels. In such laminates, the respective layers may be co-extruded or otherwise conformed, or those layers may be joined to one another subsequent to their initial formation, as for example by elevated temperature interpenetration, chemical reactions between functional groups on opposing faces in the laminate, etc. A particularly preferred laminate for the present invention comprises TYVEK® laminated or coated with one or more layers of polyethylene homopolymer, ethylene/vinyl acetate copolymer, ethylene/vinyl alcohol copolymer and vinylidene chloride/vinyl chloride copolymer.

The thickness of the polyethylene films is generally in the range of about 0.8 to 10 mils. The total thickness of a laminate is generally about 10–30 mils.

The preferred laminated fabric is the lowest cost, most flexible, lightest weight disposable protective garment for chemical splash protection and most chemical vapors.

Embossing or creping the outer layer or outer laminate produces a fabric which has improved flexibility and stretchability so as to give additional freedom of movement to the wearer.

In addition to maximizing the material of construction, the disposable protective coverall garment of this invention incorporates the benefit of a set sleeve coverall and that of a separated top and bottom coverall design. FIG. 1 clearly shows more freedom of movement when the wearer stretches his arms overhead or to his front or when bending. This is opposed to a yoke type sleeve as shown in FIG. 2 where the yoke design is restrictive in its reach both to the front and overhead and while bending. This is quite apparent when comparing critical stress position A of the garment made according to this invention and the critical stress position B as shown in FIG. 2 which represents the problems associated with the yoke sleeve design.

While the invention has been described with specific reference to illustrative embodiments and specific features, it will be recognized by those skilled in the art that the utility of the present invention is not thus limited, but rather extends to other modifications, variations, and embodiments.

What is claimed is:

1. A pattern for forming from polymeric material a disposable protective coverall garment comprising:

an upper bodice member blank made from a single piece; the polymeric material substantially free of any seams or folds having a cut-out for the neck adapted for collar attachment and cut-out for set sleeve attachments; said sleeve cut-outs being for attaching sleeves at an angle of 45 to 70 degrees from the horizon.

lower torso member blanks including depending leg portions for forming a relatively wide crotch and body fullness in the region of the crotch;

a collar member blank; and sleeve member blanks for forming sleeves configured for set sleeve attachment, said sleeve member blanks having one end wider than the other.

2. In a protective garment having a trouser portion and an upper body portion with sleeves, the improvement which comprises said sleeves being tubular and having a greater diameter at the portion attached to the upper body portion at an angle of about 45–70 degrees by bonding, said upper body portion being formed from a one piece blank which is free of seams and said trouser portion being entirely formed from two identical parts which contain leg portions.

3. The protective garment of claim 2 wherein said sleeves are attached at an angle of about 60 degrees.

4. The protective garment of claim 2 wherein said sleeves are fusion bonded.

5. The protective garment according 2 including an upper body portion made from a single piece of polymeric material substantially free on any seams and connected to said trouser portion, which provides a relatively wide crotch and body fullness in the region of the crotch of the garment and a fastening means for opening and maintaining said garment in a closed relation.

6. The protective garment according to claim 5 wherein said garment is of uni-layer or multi-layer construction.

7. The protective garment according to claim 5 wherein said fastening means is a zipper strip.

8. A protective garment formed from a blank of polymeric material which forms an upper body portion and a trouser portion, said upper body portion having a cut-out for a neck and cut-out for sleeves to be at an angel of 45 to 70 degrees, said trouser portion consisting of two identical parts which include leg making portions, and including sleeve forming members wherein said sleeve forming members provide one end wider than the other end for bonding at said cut-outs for sleeves.

* * * * *